United States Patent [19]

Kraft

[11] Patent Number: 4,892,437

[45] Date of Patent: Jan. 9, 1990

[54] CONCRETE FINISHING FLOAT WITH REAR FITTING BAR

[76] Inventor: Simon Kraft, 7501 W. 99th Ter., Overland Park, Kans. 66212

[21] Appl. No.: 197,279

[22] Filed: May 23, 1988

[51] Int. Cl.[4] ..... E01C 19/22

[52] U.S. Cl. ..... 404/97; 404/114

[58] Field of Search ..... 404/97, 114, 118–120; 15/235.4, 235.5, 235.8, 144 R; 425/458

[56] References Cited

U.S. PATENT DOCUMENTS

| | | | |
|---|---|---|---|
| 1,021,557 | 3/1912 | Runner | 404/97 X |
| 1,590,342 | 6/1926 | Abram | 15/235.8 |
| 1,713,513 | 5/1929 | Abram | 139/219 |
| 2,834,199 | 5/1958 | Freeman | 15/235.8 |
| 2,934,937 | 5/1960 | Bennett | 15/235.8 |
| 2,999,261 | 9/1961 | Lapham | 15/235.8 |
| 3,090,066 | 5/1963 | Ferrell, Jr. et al. | 15/235.8 |
| 3,146,481 | 9/1964 | Chiuchiarelli | 15/235.8 |
| 3,162,881 | 12/1964 | Negwer | 15/235.8 |
| 3,729,765 | 5/1973 | Peterson | 15/235.8 |
| 3,798,701 | 3/1974 | Burn et al. | 15/235.8 |
| 3,803,662 | 4/1974 | Glejf | 15/104 S |
| 4,335,485 | 6/1982 | Paine et al. | 15/235.8 |
| 4,520,527 | 6/1985 | Maggio et al. | 15/235.8 |
| 4,702,641 | 10/1987 | Naser et al. | 404/97 |

FOREIGN PATENT DOCUMENTS

| | | | |
|---|---|---|---|
| 971200 | 9/1964 | United Kingdom | 15/235.4 |

*Primary Examiner*—Jerome W. Massie, IV
*Assistant Examiner*—Gay Ann Spahn
*Attorney, Agent, or Firm*—Litman, McMahon & Brown

[57] ABSTRACT

A concrete finishing float for finishing wet concrete consists of a long, detachable handle assembly which is attached to a float by means of an incline adjusting mechanism. This mechanism allows the user from a remote location by the use of a long handled shaft to alter the incline of the float in relation to the handle assembly while the float is in use by axially rotating the handle assembly. The incline adjusting mechanism includes a rod which connects the handle receiving member to the float. Axial rotation of the handle causes the rod to move the float relative to the handle.

8 Claims, 2 Drawing Sheets

Fig. 6.
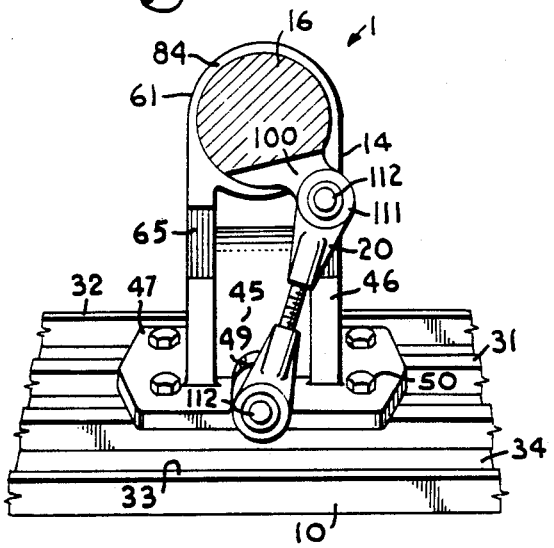
Fig. 7.
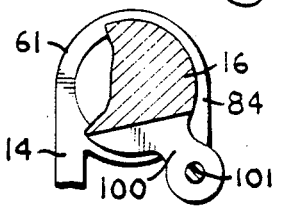
9.
Fig. 8.
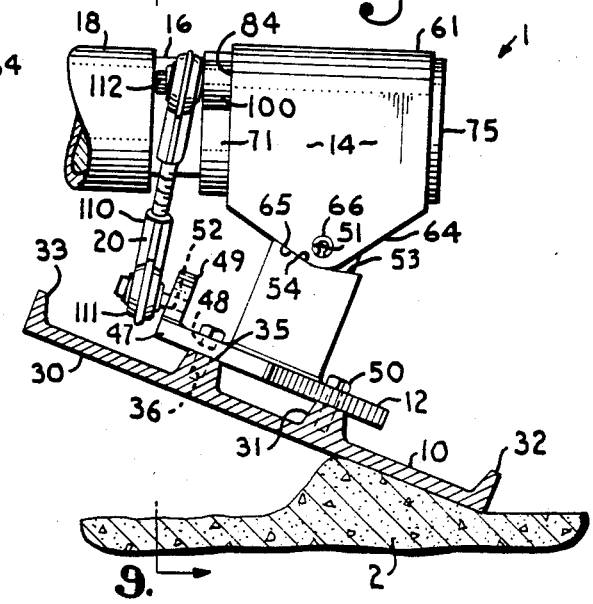
9.
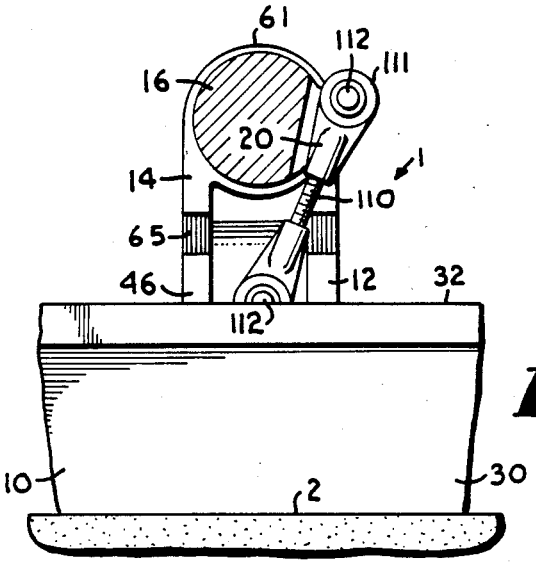
Fig. 9.
Fig. 10.
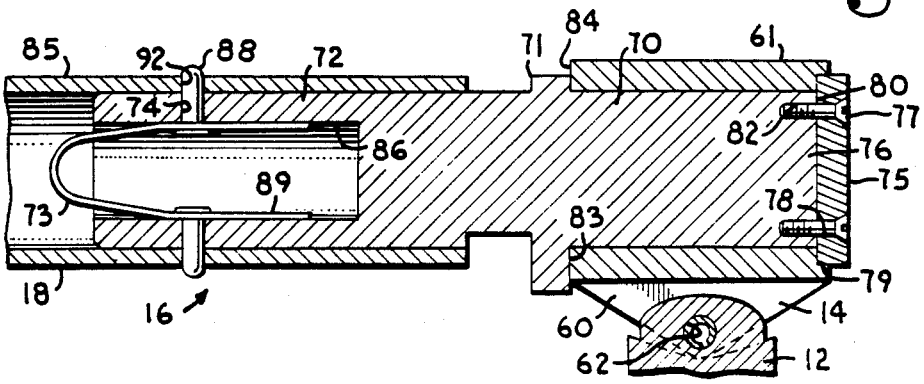

CONCRETE FINISHING FLOAT WITH REAR FITTING BAR

BACKGROUND OF THE INVENTION

1. Field of the Invention

This invention relates to a concrete finishing tool which allows a user to adjust the angle of a concrete finishing float as it is being pulled towards or pushed away from the user.

2. Background Discussion

It is frequently necessary to use a cement finishing float for the purposes of providing a smooth finish to large slabs of concrete or to establish a wet cement surface gradient. During use, it is desirable that such tools be provided with a means for tilting the float work face from the remote end of a handle connected to the float to facilitate the forward pushing and backward pulling of the float as it moves over the wet soft cement surface. Long reach floats are necessary as it is undesirable to walk over an unset cement surface since to do so would disturb the natural settling and separation processes associated with cement curing. The prior art discloses a number of methods for tilting the float relative to the handle. However, typically such methods are complicated and are therefore cumbersome to operate and difficult to position and maintain at a desired tilt angle. Thus, often such methods are ineffective. The mechanisms also suffer disadvantages such as susceptibility to wear, difficulty of maintenance, torque problems associated with the use of long handled shafts. In addition, other mechanisms such as that disclosed in the Maggio '527 patent employ linkage arrangements for altering the incline of the float which are positioned at the front most part of the mechanism. At this position, the linkage is exposed to physical damage during use which causes the linkage to malfunction.

SUMMARY OF THE INVENTION

The device is simple in structure and inexpensive to manufacture.

This float is provided with a sectionalized handle which may be readily connected without the need for threaded fasteners. The float itself is easily disconnected from the elongated handle to facilitate storage.

The handle is detachably connected to the float by a coupling means which includes a spring loaded detent connection. The present invention also includes tilt limiting stops, a yoke, a handle receiving means, and a rod pivotally connected at one end to the handle receiving means and at its other end to the float. The angle of incline of the float may be adjusted from the remote end of the handle by the user to facilitate forward and backward movement of the float across wet cement with a desired angle of the finished work.

OBJECTS OF THE INVENTION

The objects of the present invention are to provide a float with an incline producing linkage which is located at a position on the mechanism which is minimally exposed to the torturous environment; to provide a mechanism with incline limiting stops; to provide an improved concrete finishing float tool which provides a reliable and easy way to change the angle of incidence of the float relative to the surface of the cement by the user's rotation of the handle at a remote location; to provide such a concrete finishing float which permits easy assembly and disassembly for storage purposes; to provide a strong, durable, and uncomplicated mechanism; to provide such a concrete finishing float which is efficient in operation, economical to manufacture, capable of long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 6 is a back elevational perspective view of the tool showing the bar pivotally connected to the handle at one end and pivotally connected to the mounting bracket at the other end.

FIG. 7 is a fragmentary, cross-sectional back view of the yoke and handle receiving means.

FIG. 8 is a side sectional view of the present invention with the float tilted to the maximum extent possible in the direction opposite that shown in FIG. 3.

FIG. 9 is a view of the tool of this invention taken along the line 9—9 of FIG. 8.

FIG. 10 is a fragmentary, cross-sectional side elevation view of the handle shaft and handle receiving means as it is mounted in the yoke.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
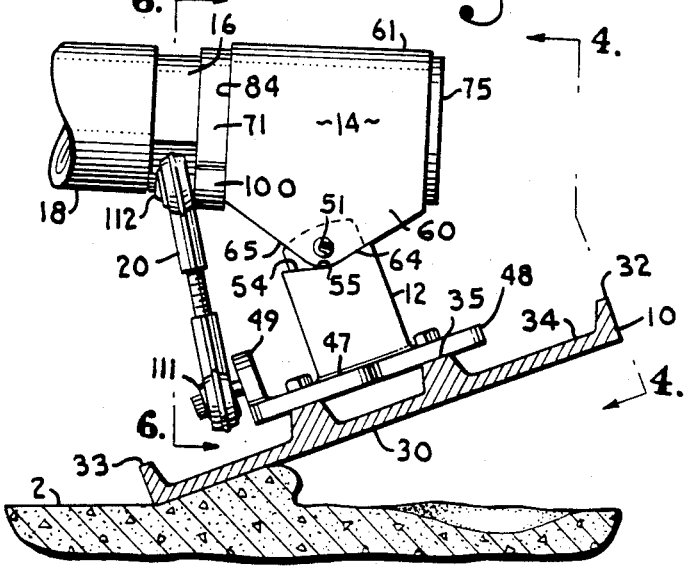
FIG. 3 is a fragmentary side elevation of the use of the present invention with the float plate inclined to the maximum extent possible in one direction.
Figure 5:
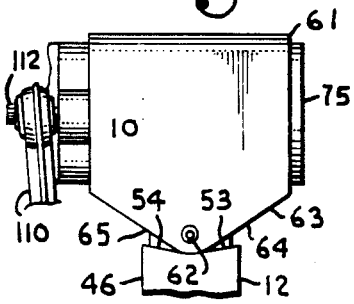
FIG. 5 is a side view of the tool with the present invention.

The terms "rear" and "forward" and similar terms refer to directional orientations to the left and right respectively of the invention as oriented in FIGS. 3 and 8.

The reference numeral 1 generally designates a concrete finishing float 1 for creating a smooth surface on a wet concrete surface. The concrete finishing float 1 comprises a float 10, a support means lower portion, in this example in the form of a yoke mounting bracket 12, a support means upper portion, in this example in the form of a yoke assembly 14, a hinge 15, a handle receiving means 16, a handle shaft 18 and a link rod assembly 20.

Figure 1:
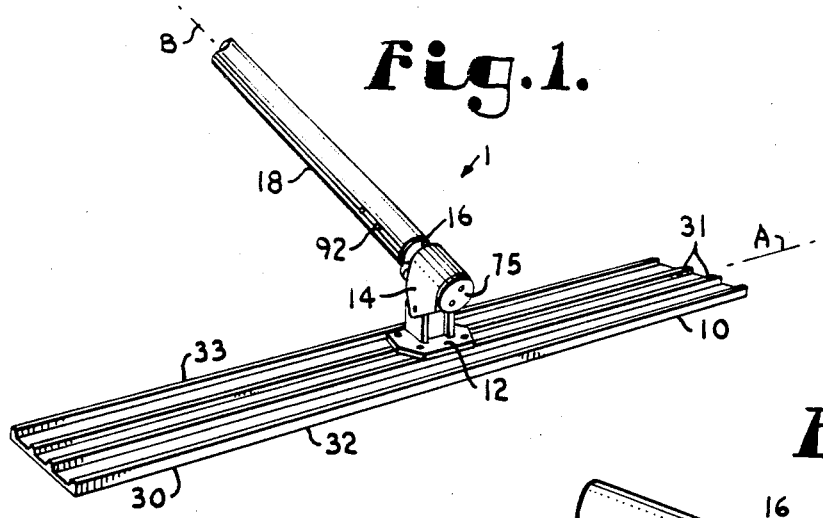
FIG. 1 is a perspective view of the concrete finishing tool embodying the present invention.
Figure 2:
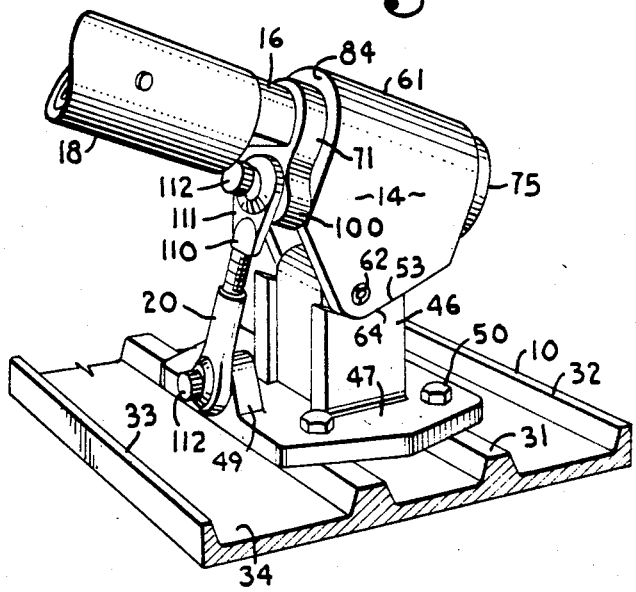
FIG. 2 is a fragmentary, elevational perspective view of the present invention.
Figure 4:
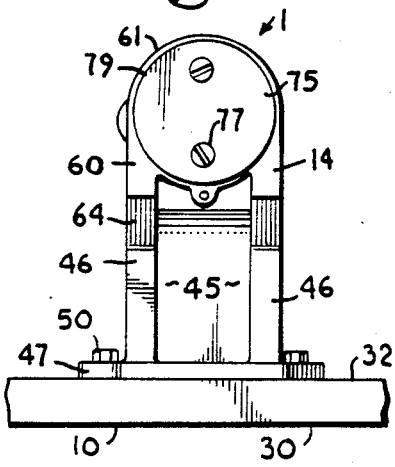
FIG. 4 is a fragmentary, front elevational view taken on the line 4—4 of FIG. 3.

The float 10 including a forward edge 28 and a rear edge 29 comprises a rectangular surfacing face 30, a pair of central longitudinal ribs 31, a front longitudinal rib 32, a back longitudinal rib 33, a top face 34, an attachment surface 35, and rib mounting aperture 36 (although a ribbed, rectangular surfacing float is shown in FIG. 1, it is foreseen that other conventional floats, trowels, or the like may be used with the invention). The rectangular surfacing face 30 interfaces with the wet concrete surface to create the desired surface or texture. The center longitudinal ribs 31, the front longitudinal rib 32, and the back longitudinal rib 33 extend parallel to the longitudinal axis a (FIG. 1) across the top face 34 and are provided to improve the structural strength of the float. The center longitudinal ribs 32 also provide an attachment surface 35 whereon the mounting apertures 36 are located.

The yoke mounting bracket 12 comprises a central yoke support 45, a hinge stop means, in the present example, in the form of a pair of incline stops 46, a base plate 47, base plate mounting apertures 48, and a pivot rod mounting bracket 49. The base plate 47 is generally rectangular in shape with the base plate mounting apertures 48 located generally near each of the corners of the base plate 47. The base plate 47 is mounted centrally on the top face 34 of the float 10. The central axes of the base plate mounting apertures 48 align with the axes of the rib mounting apertures 36 for the purpose of fixedly attaching, with mounting bolts 50, the base plate 47 to the top face 34 of the float 10. The central yoke support 45 is centrally located on the base plate 47 and extends upwardly therefrom. A yoke mounting aperture 51 is positioned in the upper portion of the central yoke support 45 and its central axis is in vertical alignment with the longitudinal axis a (FIG. 1) of the float 10.

The incline stops 46 are generally square shaped plates which abut the outer sides of the central yoke support 45. A forward upper stop surface 53 and a rear upper stop surface 54 comprise the upper surface 55 of the incline stop 46. Both the forward upper stop surface 53 and the rear upper stop surface 54 incline downward as they progress toward center of the incline stop 46 making the top surface 55 generally "u" shaped.

The pivot rod mounting bracket 49 extends upwardly from the back edge of the base plate 47 and a pivot rod mounting aperture 52 is positioned in the pivot rod mounting bracket 49 with its central axes at right angles to the longitudinal axes of the float 10.

The yoke assembly 14 comprises a pair of yoke members 60 and a rotatably connecting means, in the present example, in the form of a sleeve 61 with a shaft retainer shoulder 65. The pair of yoke members 60 are attached tangentially to and extend downwardly from the sleeve 61 and are in parallel relation to one another. The outer diameter of the sleeve 61 is such that when yoke members 60 are tangentially attached to the sleeve 61 and extend downwardly therefrom in a parallel orientation, the distance between the inner surfaces of the yoke members 60 is uniform and slightly greater than the width of the central yoke support 45 along its axis corresponding to the longitudinal axis a (FIG. 1) of the float 10. Positioned in the yoke members 60 are spring pin apertures 62, the diameter of which equals the central axis of the yoke mounting aperture 51 of the central yoke support 45 of the yoke mounting bracket 12.

An incline stop surface 63 comprises the bottom surface of each yoke member 60 and is generally "u" shaped and is of slightly greater curvature than the upper surface 55 of the incline stops 46. The incline stop surface 63 comprises a forward lower stop surface 64 and a rear lower stop surface 65, both of which meet at the bottom of the "u" of the incline stop surface 63.

Hinge 15 is formed when the yoke assembly 14 is mounted on the yoke mounting bracket 12 by aligning the spring pin apertures 62 in each yoke member 60 with the yoke mounting aperture 51 in the central yoke support 45 of the yoke mounting bracket 12. Once aligned, a spring pin 66 is forced through the spring pin aperture 62 of one yoke member 60, through the yoke mounting aperture 51 and finally through the spring pin aperture 62 of the remaining yoke member 60, thus allowing pivotal rotation of the yoke assembly 14 on the yoke mounting bracket 12.

As the float 10 and yoke mounting bracket 12 are rotated about the longitudinal axis of the yoke mounting aperture 51 in the central yoke support, the maximum angle of inclination of the front edge of the float 10 is achieved when the forward upper stop surface 53 of the pair of incline stops 46 abuts against the forward lower stop surface of the pair of yoke members 60. The maximum angle of inclination of the back edge of the float 10 is achieved when the rear upper stop surface 54 of the pair of incline stops 46 abuts against the rear lower stop surface 65 of the pair of yoke members 60.

The handle receiving means 16 comprises a yoke sleeve shaft portion 70, a shaft collar 71, a handle receiver portion 72, a detent spring 73, a detent aperture 74 and a sleeve shaft retainer plate 75. The yoke sleeve shaft portion 70 is of an outside diameter slightly less than the inside diameter of the sleeve 61 to allow for rotation of the yoke sleeve shaft 70 in the sleeve 61. Once the yoke sleeve shaft portion 70 is slid into the sleeve 61, the sleeve shaft retainer plate 75 which is circular in shape is abutted against a yoke sleeve shaft end 76 of the yoke sleeve shaft portion 70 such that their respective central axes align. The sleeve shaft retainer plate 75 is fixedly attached to and abutted against the yoke sleeve shaft end 76 by means of securing screws 77 inserted through a pair of securing apertures 78 positioned in the sleeve shaft retainer plate 75 such that they align with a pair of threaded apertures 82 positioned in the yoke sleeve shaft end 76 at some small distance from the outer edge of the yoke sleeve shaft 70.

The sleeve shaft retainer plate 75 is of an outer diameter slightly less than the inner diameter of the shaft retainer plate shoulder 79 positioned at a sleeve front face 80 such that the sleeve shaft retainer plate 75 can easily rotate when nested into the shaft retainer shoulder 79.

Fixedly attached to the yoke sleeve shaft 70 at its back end is the sleeve collar 71 which is generally circular in shape. The outer diameter of the shaft collar is slightly greater than the inner diameter of the sleeve 61 with the inner diameter of the shaft collar 71 such that it tightly fits over and is held in place on the yoke sleeve shaft portion 70. The shaft collar 71 is positioned on the yoke sleeve shaft 70 at a position such that when the yoke sleeve shaft 70 is positioned in the sleeve 61 with the sleeve shaft retainer plate 75 attached at its yoke sleeve shaft end 76 and the sleeve shaft retainer plate 75 is firmly nested in the shaft retainer shoulder 79, a shaft collar front face 83 on the front face of the shaft collar 71 snugly abuts against a back sleeve face 84 of the sleeve 61 holding the handle receiving means 16 snugly within the yoke assembly 14.

The handle receiver portion is positioned at the back of the handle receiving means behind the shaft collar 71. Its outer diameter is slightly less than the inner diameter of the handle shaft 18 such that the handle shaft 18 may be slid over the outer surface 85 of the handle receiving portion 72. The handle receiving portion 72 has a detent spring bore 86 for receiving a detent spring 73.

The detent spring 73 is generally "u" shaped with a pair of detents 88 positioned in each of a pair of detent spring legs 89. The detents 88 are positioned in the detent springs 73 such that when it is inserted in the detent spring bore 86 of the handle receiving portion 72 the detents 88 align with and are inserted into a pair of detent apertures 74 in the yoke sleeve shaft portion 70 and also into an aligned pair of detent apertures 92 positioned in the front end of the handle shaft 18. The width of the detents 88 is slightly less than the diameter of the detent apertures 74 and detent handle shaft apertures 92 such that the handle shaft 18 will be detachably connected when it is positioned over the handle receiving portion 72.

Extending outwardly from the shaft collar 71 is a pivot rod collar bracket 100 extending radially outward therefrom. Positioned in the pivot rod collar bracket 100 is a pivot rod mounting aperture 101, the central axes of which is parallel to the longitudinal axes of the handle receiving means 16.

The link rod assembly 20 comprises a link rod 110 with a pair of ball and socket connectors 111 adjustably connected to a first end 112 and a second end 113. The upper ball and socket connector 111 of the link rod assembly 20 is attached to the link rod mounting threaded aperture 101 by means of a set screw 114 inserted through the ball and socket connector of the link rod assembly 20 and threaded into the link rod mounting threaded aperture 101. The head of the set screw is sufficiently sized so that it will not pass through the opening in the ball and socket connector 111. The remaining ball and socket connector 111 attached to the other end of the link rod assembly 20 is then attached to the link rod mounting threaded aperture 52 of the yoke mounting bracket 12 by means of a set screw 114 with a head of a diameter larger than the socket of the ball and socket connector 111. The set screw is inserted through the ball and socket connector and threaded into the link rod mounting threaded aperture 52. Once the link rod assembly 20 is securely fastened to the handle receiving means 16 at one end and the yoke mounting bracket 12 at its other end, the relative angle between the handle shaft 18 and the float 10 is established by the axial rotation of the handle shaft 18. The operating angle range may thus be adjusted by adjusting the length of the pivot rod assembly prior to mounting.

When connected as described above, the handle shaft 18 and the handle receiving means 16 are effectively secured together so that rotation of the handle shaft 18 rotates the handle receiving means 16 in the yoke assembly 14. The rotational motion is transmitted through the link rod assembly 20 to the yoke mounting bracket 12 causing the float 10 to rotate about the yoke mounting aperture 51 axis resulting in a relative angle change between the handle shaft 18 and the float 10.

It is to be understood that while certain forms of the present invention have been illustrated and described herein it is not to be limited to the specific forms or arrangement of parts described and shown.

What is claimed and desired to be secured by Letters Patent is as follows:

1. A tilting mechanism for an elongated concrete finishing float having a forward edge and a rear edge, comprising:

(a) support means adapted for mounting on said float; said support means having an upper portion and a lower portion, a hinge connecting said support means upper portion to said support means lower portion for tilting motion therebetween along an axis running generally parallel to the longitudinal axis of said float;

(b) an elongated shaft, rotatable connecting means for connecting said shaft to said support means upper portion whereby said shaft extends generally transversely and rearwardly of said float; and (c) a link having a first end and a second end, said link first end being adapted for pivotal connection to said shaft at a position spaced rearwardly from said rotatable connecting means; said link second end being adapted for pivotal connection below and rearwardly of said hinge for movement with said support means lower portion;

(d) stop means which are associated with said hinge means; said stop means comprising inclined stops abutting each outer side of said support means lower portion; said inclined stops having upper stop surfaces; said support means upper portion having lower stops surfaces for stopping engagement with said upper stop surfaces; and (e) whereby rotational movement of said shaft produces tilting between said support means upper and lower portions which translates into tilting motion of said float with respect to said shaft.

2. The tilting mechanism as set forth in claim 1 wherein:

(a) said link is adjustable in length.

3. The tilting mechanism as set forth in claim 1 wherein:

(a) a ball joint is provided on at least one of said link ends to facilitate universal movement between said link and structure to which it is pivotally connected.

4. A tilting mechanism for a concrete finishing float having a forward edge and a rear edge, comprising:

(a) support means adapted for mounting on said float; said support means having an upper portion and a lower portion, a hinge connecting said support means upper portion to said support means lower portion for tilting motion therebetween along an axis running generally parallel to the longitudinal axis of said float;

(b) an elongated shaft, rotable connecting means for connecting said shaft to said support means upper portion whereby said shaft extends generally transversely and rearwardly of said float;

(c) a link having first and second ends adapted for pivotal connection with respect to said support means above and below said hinge; and (d) positive stop means limiting the tilting motion between said support means upper and lower portions; said stop means comprising inclined stops abuting each outer side of said support means lower portion; said inclined stops having upper stop surfaces; said support means upper portion having lower stop surfaces for stopping engagement with said upper stop surfaces;

(e) whereby rotational movement of said shaft produces limited tilting between said support means upper and lower portions which translates into limited tilting motion of said float with respect to said shaft.

5. The tilting mechanism as set forth in claim 4 wherein:

(a) said upper and lower stop surfaces extend both forwardly and rearwardly of said hinge, thereby providing positive stop means upon tilting motion of said support means upper and lower portions in opposite directions.

6. A float mechanism for concrete finishing, said float mechanism including an elongated float having a forward edge and a rear edge:

(a) said float mechanism further including an elongated shaft;

(b) support means adapted for mounting said float to said shaft, said support means having an upper portion and a lower portion, a hinge connecting said support means upper portion to said support means lower portion for tilting motion of said float with respect to said shaft along an axis running generally parallel to said float; said support means lower portion being removably secured to said float, hinge stop means on said support means for said stop means comprising inclined stops abuting each outer side of said support means lower portion; said inclined stops having upper stop surfaces; said support means upper portion having lower stop surfaces for stopping engagement with said upper stop surfaces;

(c) means rotatably connecting said shaft to said support means upper portion, said shaft extending transversely and rearwardly of said float; and (d) a link having a first end and a second end, said link first end being pivotally connected to said shaft at a position spaced rearwardly from said hinge, said linkage second end being pivotally secured to said support means lower portion in a position spaced rearwardly from said hinge;

(e) whereby rotational movement of said shaft produces limited tilting between said upper and lower portions which translates to said tilting motion of said float with respect to said shaft.

7. The float mechanism as set forth in claim 6 wherein said first and second link ends include ball joints.

8. The float mechanism as set forth in claim 6 wherein said hinge stop means extends both forwardly and rearwardly of said hinge.

* * * * *